United States Patent [19]

Heinen

[11] Patent Number: 4,929,005

[45] Date of Patent: May 29, 1990

[54] DEVICE FOR TRANSFERRING ELECTRIC POWER

[75] Inventor: Hans-Dieter Heinen, Malmedy, Belgium

[73] Assignee: S.A. Ets. R. Heinen N.V., Malmedy, Belgium

[21] Appl. No.: 263,761

[22] Filed: Oct. 28, 1988

[30] Foreign Application Priority Data

Oct. 30, 1987 [EP] European Pat. Off. ..... 87870153

[51] Int. Cl.[5] ..... E05C 19/16

[52] U.S. Cl. ..... 292/251.5

[58] Field of Search ..... 292/144, 251.5, 201; 336/119; 70/277

[56] References Cited

U.S. PATENT DOCUMENTS

| | | | |
|---|---|---|---|
| Re. 23,636 | 3/1953 | Mark et al. | 292/251.5 |
| 1,505,325 | 8/1924 | Elbert | 336/119 X |
| 2,272,452 | 2/1942 | Whittle | 336/69 X |
| 3,263,063 | 7/1966 | Marriott et al. | 219/522 |

FOREIGN PATENT DOCUMENTS

| | | |
|---|---|---|
| 3612761 | 4/1986 | Denmark . |
| 1264587 | 5/1961 | France . |

*Primary Examiner*—Richard E. Moore

*Attorney, Agent, or Firm*—Blum, Kaplan, Friedman, Silberman and Beran

[57] ABSTRACT

A device for transferring electric power and/or information between two parts which are movable one with respect to the other, in particular between a door frame and a door leaf or an opening window leaf, mounted in this door frame, comprising a first coil wound on a first magnetic core and a second coil wound on a second magnetic core, the first coil being intended to be connected to an electric power source and to be mounted with its core on one of said parts, the second coil being intended to be mounted with its core on the other part, so that both said cores determine a magnetic circuit in at least one determined position of said parts one with respect to the other in order to so allow a variable electric current travelling in said first coil to induce a variable magnetic flux in both cores, and creates an electric current in the second coil when the latter is connected to a closed electric circuit.

7 Claims, 3 Drawing Sheets

DEVICE FOR TRANSFERRING ELECTRIC POWER

This invention relates to a device for transferring electric power and/or information between two parts which are movable one with respect to the other, in particular between a door frame and a door leaf or a casement window leaf, arranged in said door frame, between a cover and the access edges of an enclosure closed by this cover, between a drawer and the frame whereinto said drawer can slide and the like, this device comprising a first coil of an insulated conductor wire which is wound onto a first magnetic core, and a second coil of an insulated conductor wire which is wound onto a second magnetic core, the first coil being intended to be connected to a power energy source and to be mounted with its core on one of said parts, the second coil being intended to be mounted with its core on the other part, so that said two cores determine a magnetic circuit in at least one determined position of said parts one with respect to the other so as to thus allow a variable electric current travelling in said first coil to induce a variable magnetic flux in both cores, by inducing an electromotive force in the second coil and provides an electric current in said second coil when the latter is connected in a closed electric circuit.

Such a device for power transfer has been in particular known from DE-A-3 612 761.

This known device only allows the energy transfer with a low power, which thus only ensures loading of a battery. The battery is absolutely necessary to accumulate the necessary power for controlling a door lock, to which the device is intended.

As a matter of fact, the battery controls the lock via the base of a transistor which allows an electric current to pass, as soon as the latter reaches the threshold voltage of this transistor.

So this known device has non negligible drawbacks resulting from the presence of a battery, in particular due to the fact that the battery condition has to be controlled regularly and to the fact that, in spite of a regular control, the risk always exists that said battery becomes unstable between control periods.

Moreover, a lock controlled through a battery ensures substantially no security against house-breaking, being given that in general the location of the battery in the door leaf can easily be determined and that it is generally easy to act on the lock by applying to the base of the transistor controlled by the battery, a high enough voltage, namely a voltage which is higher than the threshold voltage of the latter.

One of the essential purposes of the present invention is to remedy all said drawbacks and moreover to provide a device of an extremely simple design, which is very useful for transferring not only a power but also some information of any kind, and this substantially in any position of both parts are with respect to the other.

To this end, in the device according to the invention, for transferring electric power and/or information between two parts which are movable one with respect to the other, each of said coils is connected in parallel to a capacitor so as to form resonant circuits, so that transfer of energy is essentially made at the resonance frequency of said circuits.

According to a particular embodiment of the invention, one of said parts being movable between a closing position and an opening position with respect to the other part, the magnetic cores are arranged in each of said parts so that the possible air gap between the cores is minimum when both parts are in a closing position one with respect to the other.

According to another particularly advantageous embodiment, both said parts being a door frame, on the one hand, and a door leaf or window leaf, on the other hand, the second coil with its core are mounted in the edge of this leaf, while the first coil with its core are mounted in the door frame, so as to be situated opposite the second coil with its core when the leaf is in its closing position in the door frame and thus to form a minimum air gap between the magnetic cores of both coils.

Other details and features of the invention will become apparent from the following description given by way of a non-limitative example of a particular embodiment of the device for transferring power and/or information according to the invention such as applied on a door; the reference numerals used in this description relate to enclosed Figures.

In the various Figures, same reference numerals relate to same elements.

Figure 1:
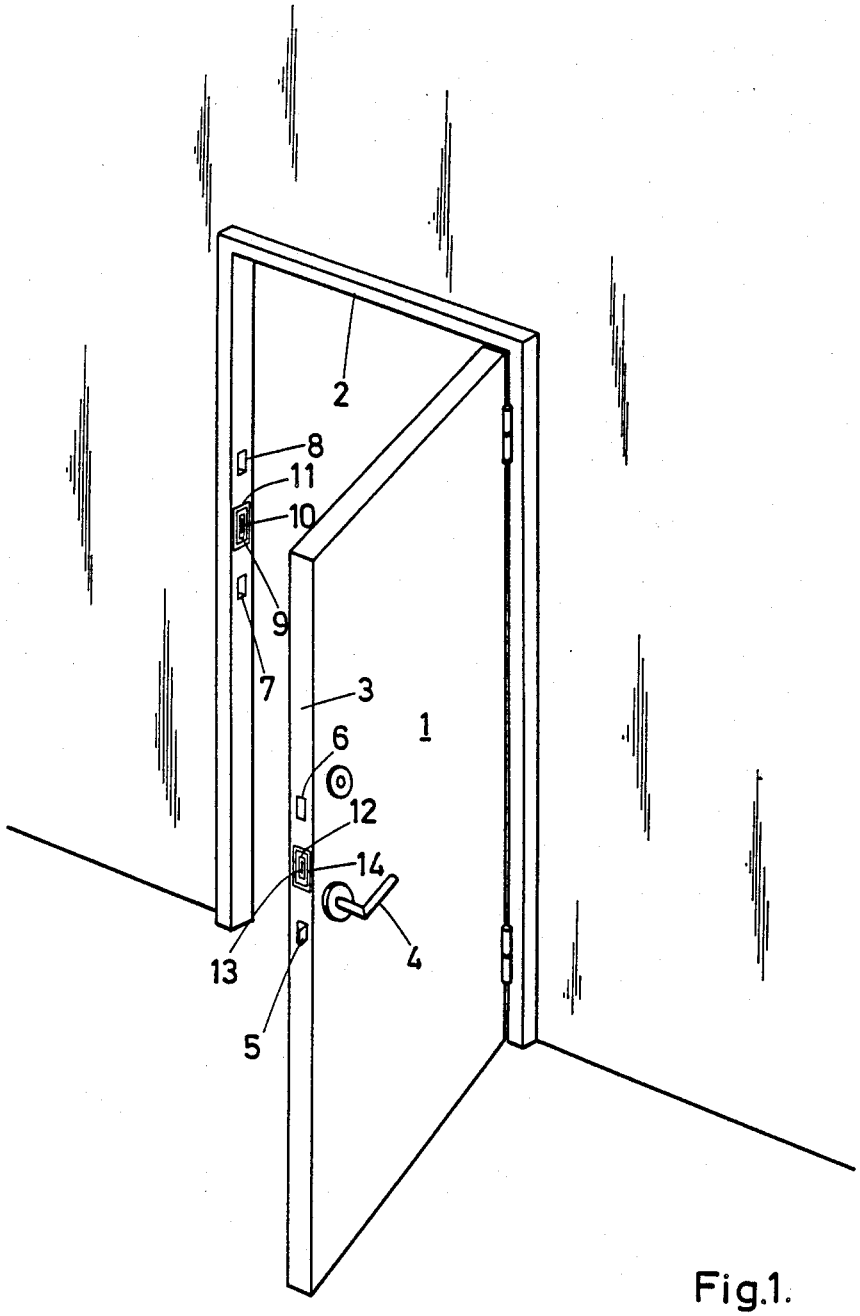
FIG. 1 is a perspective view of a door equipped with a device for transferring power and information according to this particular embodiment of the invention.

The invention concerns in general a device for transferring electric power and/or information between two parts of any kind, which are movable one with respect to the other.

However, this device more particularly finds an application for transferring some power between a door frame and a door leaf and/or a casement window leaf, mounted in this door frame, between a cover and the access edges of an enclosure closed by this cover and finally between a drawer and a frame whereinto said drawer can slide.

This device comprises a first electricity conducting coil comprising an insulated conductor wire which is wound on a first magnetic core, for example of ferrite, and a second electricity conducting coil, the number and the diameter of the turns thereof may be identical to or different from the number and diameter of the turns of the first coil, this second coil being wound on a second magnetic core, for example also of ferrite, the shape and sizes of this second core being the same as or different from those of the first core.

The first coil is intended to be connected to a source of electric power and to be mounted with its core on one of above mentioned two parts, while the second coil is intended to be mounted with its core on the other part.

The arrangement of said two coils with their respective cores, one with respect to the other, is such that said two cores determine a magnetic circuit in at leat one determined position of said parts one with respect to the other so as to so allow that a variable electric current, for example an alternating current, in said first coil generates a magnetic flux in both cores. The flux variation gives rise to an induced electromotive force at the terminals of the second coil. This electromotive force will give rise to an electric current in this second coil when the latter is connected in a closed electric circuit.

This device is characterized in that each of the coils is connected in parallel to a capacitor so as to form resonant tuned circuits, so that the power transfer is essentially made at the resonance frequency of said circits and that so a high power level in a relatively reduced volume is obtained, which is able to control a mechanism directly, such as a lock, without a battery is necessary.

In order to ensure, in at least one relative position of the two parts, a power transfer betwen the two coils with a maximum yield, it is desirable that the air gap between the two magnetic cores is minimum or even, if possible, null in this relative position.

Thus, if one of the two above-mentioned parts is movable between a closing position and an opening position one with respect to the other, it could be for example useful that this air gap is minimum or null when the two parts are in their closing position one with respect to the other.

In some cases, it could be useful that, in this closing position, means are provided, such as springs, in order to apply the cores one against the other, so as to delete the air gap.

Since a particular preference is given to the application of the device according to the invention on doors, the enclosed figures, which are described hereinafter concern this preferred embodiment.

The Figures show a door leaf 1 mounted in a door frame 2 and hinged to the latter.

Figure 2:
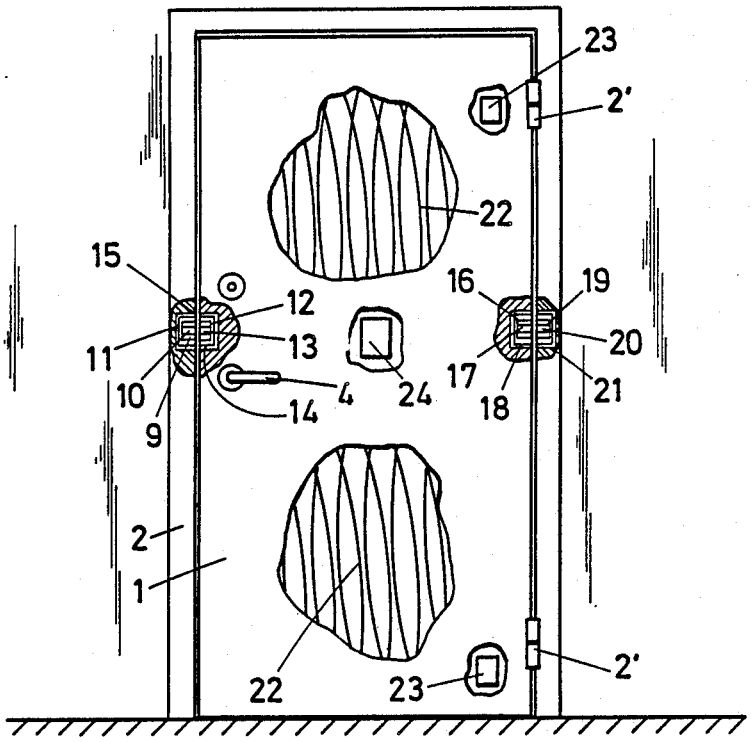
FIG. 2 is a partly broken, elevation view of the door in the closing position.

In this particular embodiment, the first coil 9 and its core 10 are arranged in a recess 11 of the door frame, while the second coil 12 and its core 13 are mounted in a recess 14 provided in the edge 3 of the door leaf, so that when the door leaf 1 is in its closing position in the door frame, as shown by FIG. 2, the coils with their corresponding cores are located opposite each other, thus forming in this position a minimum air gap 15 between both cores 10 and 13.

The terminals of coil 9 are connected through conducting wires 9' to a source of electric power which in this particular embodiment is an oscillator 39 supplying coil 9 with an alternating current having a frequency between 500 and 50,000 Hertz.

The second coil 12 is connected in an electric circuit 28 controlling the electro-magnet 25 of a lock embedded in the door leaf 1.

This lock comprises a latch bolt 5 which can be directly controlled through a handle 4, on one side of the door, and a dead bolt 6 which can be actuated with a key, not shown in the Figures.

In their closing position, these bolts 5 and 6 fit into lock staples 7 and 8 respectively, which are provided in the door frame 2.

The electro-magnet 25 can for example have as a function, when it is energized, to bring the latch bolt 5 into an opening position.

The device according to the invention is preferably made up of a self-contained block which through very simple mechanical and electrical means is connected to the controlling means of any lock known per se and which moreover allows at the same time the transfer of any kind of information independently of the lock.

Accordingly it has not been considered as being useful to describe the lock in a detailed manner in the context of the present invention.

In order to allow the space required for said coils with their respective cores to be reduced to the strict minimum and thus to allow their fitting into an as reduced as possible space, in particular in the edge of a door leaf, such as shown by FIG. 2, while ensuring an energy transfer which is high enough to control the lock directly, without an electric battery is needed, a capacitor 40 and 41 is connected in parallel to coil 9 and coil 12 respectively, the capacitor value being selected so as to obtain a resonance at the frequency of the excitation signal produced by the energy source.

Thus, each coil defines with its corresponding capacitor which is called "a tuned circuit" allowing to induce in the coils, for a given relatively low strength of an excitation signal, a high enough electric current, and this with coils comprising a relatively low number of turns.

For each tuned circuit, the values of the components thereof are given by the following relations:

$$f = \frac{1}{2\pi\sqrt{L_1C_1}} \quad (1)$$

and $$f = \frac{1}{2\pi\sqrt{C_2C_2}} \quad (2)$$

wherein:

$L_1$ = the inductance measured at the terminals of the coil 9 taking into account the influence of $L_2$;

$L_2$ = the inductance measured at the terminals of the coil 12 taking into account the influence of $L_1$;

$C_1$ = the capacitance of the capacitor 40 connected in parallel to the coil 9;

$C_2$ = the capacitance of the capacitor 41 connected in parallel to the coil 12.

Figure 4:
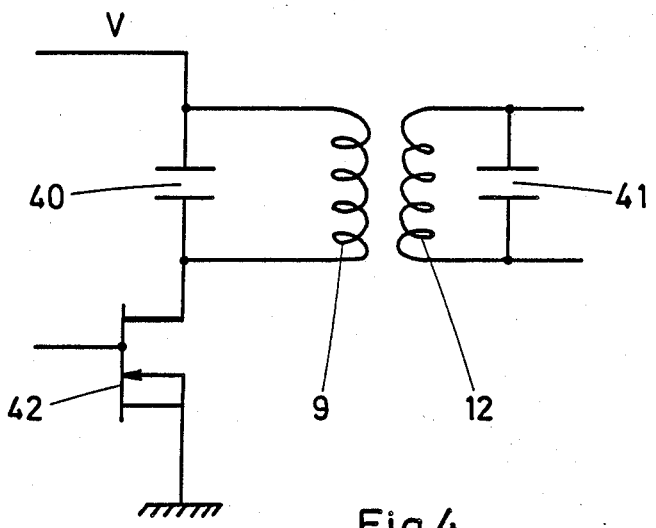
FIG. 4 is a view, at a larger scale, of a detail of an essential element of the device according to the invention.

In order to allow this particular embodiment to be illustrated in a more concrete manner, a working example will be given hereafter with reference to FIG. 4.

In the example, the coils are arranged on magnetic cores of ferrite Siemens type B66341 Gx 127 EC 52X24X14 Mat N27.

For this particular type of tuned circuit, inductance L is given by the relation:

$$L = n^2 A_L,$$

wherein $A_L = 93{,}10^{-3}\ \mu H/tr^2$ n being the number of turns of the induction coil, tr being the unit of the turn number.

This relation is valid on condition that coupling between both coils is neglected.

For a first coil 9 made up of insulated copper wire having a diameter of 0.5 mm, comprising 35 turns, and a second coil 12 made up of the same wire, comprising 55 turns, one obtains with relations (1) and (2):

$$L_1 = 116\ \mu H$$

$$L_2 = 280\ \mu H.$$

The capacitances $C_1$ and $C_2$ are then only given by relations (1) and (2).

The frequency used in these examples is 16 kHz.

In practice, however, the values $C_1$ and $C_2$ differ to a slight extent from the values obtained from relations (1) and (2) for the two following reasons:

(a) these relations do not take into account the coupling between $L_1$ and $L_2$;

(b) $C_1$ plays also the role of a damper on the overvoltage produced by the self coil at the time of the conduction stop of the transistor.

For both these reasons, the final values of $C_1$ and $C_2$ have been defined experimentally and are as follows:

$C_1=330$ nF and $C_2=300$ nF.

A pulsating current is obtained at the terminals of coil 9 by using a field effect transistor 42 which intermittently interrupts the current in the coil 9, the other terminal being connected with a direct current source.

Figure 3:
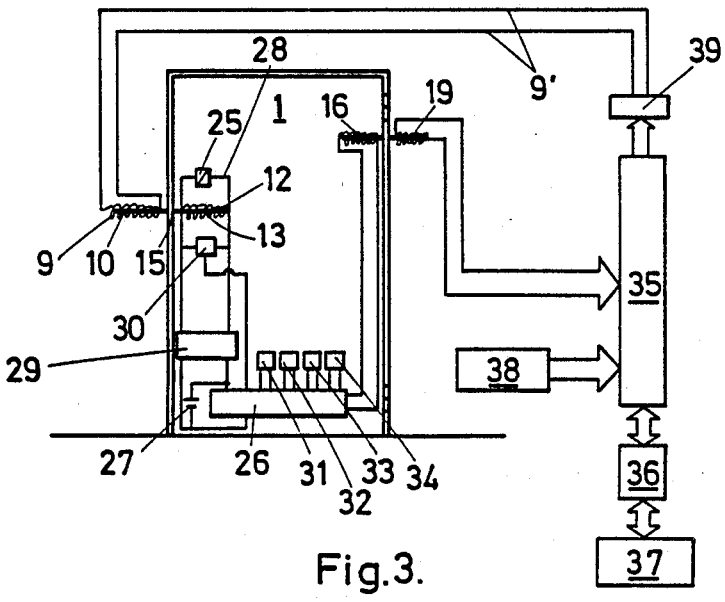
FIG. 3 is a schematic view of the electric circuit of this particular embodiment of the device for transferring energy and information according to the invention.

This connection thus ensures the function of the oscillator 39 shown in FIG. 3 and which has been referred to hereinabove.

Figure 5:
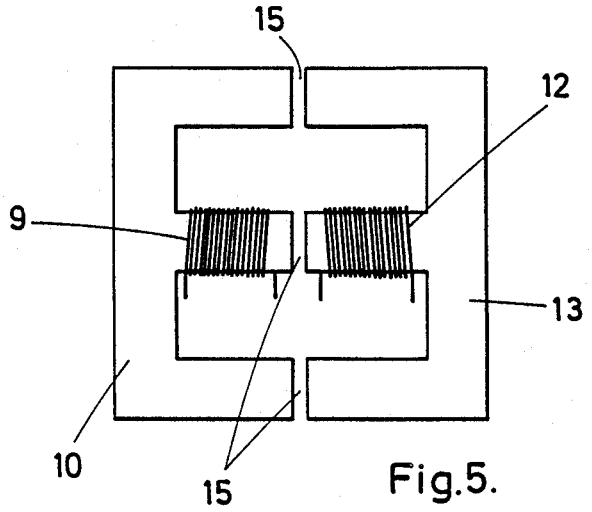
FIG. 5 is a schematic view of another detail of this essential element of the device according to this particular embodiment of the invention.

In order to obtain an as reduced as possible air gap, according to a particular embodiment of the invention use is made of two magnetic cores 10 and 13 which are substantially identical and which are each U-shapedl, as shown in FIG. 5.

The coils, 9 and 12 respectively, are wound on the central leg of these cores and the free ends of this leg and of the two other legs of one of the cores are orientated towards the free ends of the corresponding legs of the other core at the time when they are in their position which is the nearest to one the other, which, in the present case, is the closing position of the door.

The device according to the invention is suitable not only for the energy transfer which is necessary for controlling mechanical elements, such as the bolt of a door lock, but can also be advantageously used for transmission of electric signals transferring information between two parts moving one with respect to the other.

Thus, the device according to the invention is particularly suitable for transmission of information on the condition of a door.

The condition of the door is characterized by its position, open or closed, its thermal homogeneity and its mechanical situation, such as tensions, distortions, defects and the like.

To this end, according to the invention, the door leaf 1 may comprise an assembly of electronic and electric circuits, which is directly or indirectly supplied through above-described coils 9 and 12.

This assembly may comprise series conductors distributed on substantially the whole surface of the door leaf, inside the latter, so as to form which is called "surface loops" 22, which can be permanently swept by a low electric current.

This assembly of electronic and electric circuits may also comprise a series of vibration sensors 23 and thermal sensors 24 which are also distributed in an invisible manner on the whole surface of the door leaf 1 and which allow to detect abnormal mechanical vibrations and temperature variations on this surface. These vibrations or temperature variations may thus also result from an attempt at house-breaking or fire.

The sensors 23 and 24 are connected to contacts 31 and 34 respectively of an electronic centralization unit 26 which collects and manages the information coming from the sensors, the surface loops and the lock. To this end, the surface loops are directly connected to this centralization unit 26, without separate contacts since they ensure themselves the function of contacts. As a matter of fact, any abnormal variation which occurs when the current passes through said loops, caused at the time of an attempt at cutting the door or at starting a fire causing deterioration or cutting of one or more loops can be detected by unit 26 and can thus give rise to a warning signal.

Concerning the sensors 23 and 24, the latter close the contacts 31 and 34 when they detect one of the above-mentioned deviations.

Moreover, the control of the door position is made by a detector which is connected in parallel to the coil 12 and which indicates, according to the voltage at the terminals of the coil 12 or of the electro-magnet 25, if the door is in an opening or closed position. This information is transmitted, in a similar manner as that coming from the sensors and surface loops, to the centralization unit 26.

The condition of the lock itself is controlled thanks to contacts 31 and 32 connected to the centralization unit 26. When the latch bolt 5 is brought to its reentered position, it opens contact 31 by furnishing a signal to this unit, while contact 32 opens when the dead bolt 6 is brought to its reentered position.

The centralization unit 26 only requires a low power amount and is permanently supplied either through the coil 12, when the door is closed or substantially closed, or through a small battery 27 incorporated in the door leaf 1. The battery 27 only furnishes a current when it appears that the power furnished by the coil 12 to the centralization unit is unsufficient.

This battery is connected in parallel to the coil 12 through a rectifier 29 which, on the one hand, prevents any energy return from the battery to the electro-magnet 27 and to the coil 12 and, on the other hand, ensures a rectification of the electric current sent by the coil to the battery.

Thus the battery can be automatically reloaded when the door is closed.

The centralization unit 26 is in turn connected to another electronic circuit 36 through two coils of conductor wires 16 and 19 each wound on a magnetic core 17 or 20, which allow transfer of information coming from the centralization unit 26, as electric signals, from the door leaf 1 to the door frame 2, and this also without mechanical bonds between the leaf and the door frame.

The coil 16 is mounted with its core 17 into a recess 18 made in the edge of the door leaf 1, on the side where the hinges 2' are located, namely where this door leaf 1 is hinged on the door frame 2.

The coil 19 is arranged with its core 20 in a similar recess 21 made in the door frame at the same level as that of the recess 18.

Thus the distance which separates the two cores 17 and 20 from each other, will always remain relatively low, even if the door is completely open, so that a magnetic circuit will always persist independently of the door position.

This has thus as a result that transfer of information coming from the centralization unit 26 to the electronic circuit 35 will be always ensured. Due to the fact that the power amount required by the transfer of this information is rather low, it has been found, according to the invention, that this amount is sufficient for any opening angle of the door 1 up to 180°.

After having travelled through the core 19, the signals are decoded in the other electronic circuit 35 possibly comprising a microprocessor. This electronic circuit 35 ensures the local treatment of information. Thus it receives amongst others the information on the data condition, on the one hand. On the other hand, it transmits some orders, for example an opening door coming from outside, previously controlled by an access control central unit 37, to the premises intended to be protected by the door and its device of energy and information transfer.

The opening control may be made, for example, by pushing onto a push-button, not shown by the Figures. This type of control can prove particularly useful for a remote opening control, and in particular from the inside of the premises to be protected.

The electronic circuit 35 is connected to an oscillator 39, which is, as already hereinabove mentioned, connected itself to the coil 9.

According to another embodiment of the device according to the invention, the transmission of information contained in the electronic circuit 21 of the door leaf 1 to the door frame 2 of the door could also be made, at least in some cases, through infrared rays for example.

The electronic circuit 35 is connected to the access control central unit 37 through a transmission interface 36, for example of the series or parallel type. A supply 38 is possibly connected with the electronic circuit 35. This supply 38 proves to be necessary if in addition to an energy transfer, intended to the opening control of the door 1, it is also desired to have an information transmission on the condition of various elements of the device.

A time switch, not shown in the Figures, may be included in the electric system, allowing to maintain the bolt 5 in its opening position, namely in its reentered position, for a limited duration from the moment when the push-button of the opening control has been pushed down. When this duration has elapsed, the bolt is automatically brought back to its closing condition, namely in projection with respect to the edge 3 of the door.

Thanks to the access control 37, it is also possible to open and possibly to bolt the door, for example by entering a code through a keyboard provided to this end, by using a magnetic card which is entered into a slot, by a remote control by means of a portable ultrasonic apparatus and the like.

The coil 9 permanently comprises an alternating current of low strength, which ensures, through the described device, the supply of electronic circuits located in the leaf 1 of the door, as well as the reloading of the battery 27 also located in the door leaf.

Energization of the electro-magnet 25 of the lock needs a higher power and is made by momentarily energizing the coil 9 with a current of higher strength.

Due to all the controls and surveys it is possible to make, thanks to the device of energy and/or information transfer according to the invention, the latter may be more particularly applied to fire-proof and anti-burglar doors.

It has been found, according to the invention, that a sufficient energy transfer can also be made when the distance between the cores is of serveral millimeters. Thus the coils with their cores can be completely embedded in the edge of the door leaf, and in the door frame surrounding the latter.

As an example, it has been found that it is possible to provide a power transfer of 6 watts when the distance between the magnetic cores is of 15 mm, this for an emitted power of 20 watts.

It has to be understood that the invention is in no way limited to the embodiments such as hereinabove described and that, within the scope of the present invention, several variants can be envisaged, in particular concerning the shape and the arrangement of the magnetic cores, the control of the door condition and the door opening and the like.

In same cases, the invention could be limited to an energy transfer device only for the opening control and possibly the bolting of the door.

Coils 16 and 19 with their respective cores 17 and 20 could possibly be omitted.

On the contrary, in other cases, the invention could be limited to an information transfer device without lock control.

The device according to the invention advantageously applies as well to doors with only one leaf as to doors with two leaves, to sliding doors or also to shutters and rolling doors.

In other cases also, coil 9 could be supplied with a low frequency current, for example of 50 Herz, so that the power could also be directly supplied from the network.

Finally, it would be possible to provide use of a coil with several insulated conductor wires, wound on a same core or on different cores fixxed on one of the parts movable one with respect to the other and able to form a magnetic circuit with one or more magnetic cores also bearing one or more coils of one of more conducting wires, which would be fixed on the other movable part.

What is claimed is:

1. A device for transferring electric power and/or information between two parts movable with respect to each other, in particular between a door frame and a door leaf or a casement window leaf, mounted in the door frame, comprising a first coil of an insulated conductor wire wound onto a first magnetic core, and a second coil of an insulated conductor wire wound onto a second magnetic core, the first coil intended to be connected to a power energy source and the core of the first coil mounted on the door frame, the core of the second coil mounted on an edge of the leaf, the first coil positioned opposite the second coil with its core when the leaf is in its closed position in the door frame forming a minimum air gap between the magnetic cores of the two coils so that said two cores determine a magnetic circuit in at least one determined position of said parts with respect to each other and allow a variable electric current travelling in said first coil to induce a variable magnetic flux in both cores, by inducing an electromotive force in the second coil and providing an electric current in said second coil when the latter is connected in a closed electric circuit, the device characterized in that each of said coils is connected in parallel to a capacitor so as to form resonant circuits, so that transfer of energy is essentially made at the resonance frequency of said circuits.

2. The device of claim 1, wherein, one of said parts is movable between a closed position and an open position with respect to the other part, the magnetic cores are arranged in each of said parts so that the possible air gap between the cores is at a minimum when both parts are in the closed position with respect to each other.

3. The device of claim 1, wherein the second coil is connected in an electric circuit provided for controlling a lock which is mounted on one of the preceding parts, while the first coil is connected to an electric power source.

4. The device of claim 1, which comprises an electric power source capable of producing an excitation signal of a frequency between 500 and 50,000 Hertz.

5. The device of claim 1, wherein the two cores are essentially identical and are E-shaped with the coil wound on the central leg of the latter, the free ends of the legs of the cores being orientated towards one another at the moment when they are in their nearest position to each other to obtain a minimum air gap.

6. The device of claim 1, which comprises emitter-receptor means connected to one of the coils for transmitting electric signals which are a function of the condition of at least one of said parts.

7. The device of claim 1, which forms an essentially self-contained assembly with respect to the electric circuit.

* * * * *